United States Patent [19]

Busanovich et al.

[11] 4,132,918

[45] Jan. 2, 1979

[54] POLYCRYSTALLINE SELENIUM IMAGING DEVICES

[75] Inventors: Charles J. Busanovich, Princeton, N.J.; Robert M. Moore, Carmel, Ind.

[73] Assignee: RCA Corporation, New York, N.Y.

[21] Appl. No.: 613,059

[22] Filed: Sep. 15, 1975

[51] Int. Cl.[2] ..... H01J 29/45; H01J 31/38

[52] U.S. Cl. ..... 313/386; 313/94

[58] Field of Search ..... 313/384, 385, 386, 390, 313/366

[56] References Cited

U.S. PATENT DOCUMENTS

| | | | |
|---|---|---|---|
| 2,687,484 | 8/1954 | Weimer | 313/386 |
| 3,350,595 | 10/1967 | Kramer | 313/386 |
| 3,405,298 | 10/1968 | Dresner | 313/385 |
| 3,861,913 | 1/1975 | Chiou | 96/1.5 |
| 3,922,579 | 11/1975 | Goto et al. | 313/386 X |

OTHER PUBLICATIONS

Goto et al., (PAL System) DIN: S4356 0203 (313-386); pp. 1-3 cited.

Nijland, "SOME INVESTIGATIONS ON THE ELECTRICAL PROPERTIES OF HEXAGONAL SELENIUM," Philips Research Reports; vol. 9, 1954; TK 1 P49; pp. 259-294.

*Primary Examiner*—Robert Segal

*Attorney, Agent, or Firm*—E. M. Whitacre; G. H. Bruestle; R. M. Rodrick

[57] ABSTRACT

A low dark current vidicon is disclosed having a target comprising a thallium doped layer of hexagonal, or trigonal, polycrystalline selenium. A mechanically stable blocking contact for holes is also provided by a transparent tin oxide electrode in intimate proximity to the layer along a major surface of a faceplate in contact with the target.

8 Claims, 3 Drawing Figures

POLYCRYSTALLINE SELENIUM IMAGING DEVICES

BACKGROUND OF THE INVENTION

The invention relates to imaging devices and more particularly to camera tubes and electrophotographic plates.

Blocking contacts are known in the prior art for reducing the dark currents normally associated with various photoconductor bodies employed in imaging devices. However, to date, no effective high resistance type photoconductive body has been developed for imaging devices having polycrystalline selenium, even where attempts have been made to also incorporate a blocking contact.

In contrast to selenium rectifiers where low resistance hexagonal (also technically known as "trigonal" selenium) polycrystalline selenium layers are conventionally employed primarily as a consequence of desired high forward current, camera tubes and electrophotographic plates have been, in general, fabricated having vitreous (i.e. amorphous) high resistance selenium layers. Such devices, are for example described in:

U.S. Pat. No. 3,350,595 issued to W. M. Kramer on Oct. 31, 1967,

U.S. Pat. No. 3,405,298 issued to J. Dressner on Oct. 8, 1968,

U.S. Pat. No. 3,861,913 issued to C. Chiou on Jan. 21, 1975; and

Great Britain Pat. No. 1,343,197 issued to Tanaka et al and filed on June 14, 1971.

The electrical characteristics of vitreous selenium and hexagonal selenium vary considerably as discussed in an article entitled "Some Investigations on the Electrical Properties of Hexagonal Selenium" by L. M. Nijland, in *Philips Res. Rep.* 9 (1954), pp. 259–294. Vitreous selenium at 20° C. is highly resistive, where the resistivity may be between $10^{10}$ ohm-cm. and $10^{14}$ ohm-cm., whereas hexagonal selenium is quite conducting and may have a resistivity from a few hundred ohm-cm. to $10^9$ ohm-cm. depending upon the concentration of halogens, or thallium impurities, respectively.

Since imaging devices ordinarily must have low dark currents, such devices have generally employed vitreous selenium because it is highly resistive and is able to form a blocking contact with n type semiconductor materials such as cadmium selenide or low work function oxidized metals such as oxidized aluminum. Considerable difficulty has been encountered in fabricating useful camera tube targets employing vitreous selenium as a consequence of the thermal instability of the material which results from its crystallization, even when abutting stabilizing layers are provided, or when arsenic or phosphorus is incorporated into the selenium material to retard crystallization. On the other hand, stable and effective amorphous selenium layers are known for electrophotographic plates, where lag characteristics of the photoconductor are less critical, which incorporate arsenic and tellurium and which do not display this undesired crystallization.

Multilayered electrophotographic plates are known in the prior art which incorporate both the vitreous (high resistance) and polycrystalline (low resistance) forms of selenium. One structure is described in an article entitled "Advances in Xerography: 1958–1962" by C. J. Claus in *Photographic Science and Engineering*, Vol. 7, No. 1, Jan.–Feb. 1963. The structure described includes a tin oxide coating upon which two selenium overlayers are successively disposed. The first overlayer comprises a panchromatic "control layer" of crystalline selenium and the second comprises a charge storage layer of amorphous selenium.

In general, there is desired a low dark current, thermally stable, high resistance photoconductive body suitable for imaging devices having a simplified construction.

SUMMARY OF THE INVENTION

A high resistance low dark current photoconductive imaging device includes a thallium doped layer of hexagonal, or trigonal, selenium in combination with a mechanically stable blocking contact for holes abutting that layer.

DETAILED DESCRIPTION

Figure 1:
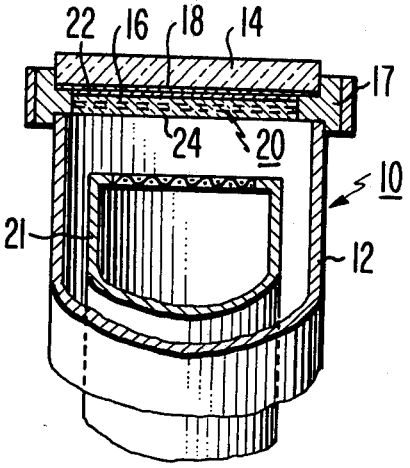
FIG. 1 is a greatly exaggerated partial cross-sectional view of a vidicon fabricated in accordance with the invention.

Referring to FIG. 1, a vidicon-type camera tube 10 is partially shown. The tube 10 is constructed in a manner well known in the art and includes a tubular glass bulb 12 having an open end portion across which a glass faceplate 14 is hermetically sealed by an indium ring 17. A target 16 extends across an inner major surface 18 of the faceplate 14. The target 16 comprises a photoconductive body 20 and a transparent conductive coating 22 between the inner major surface 18 of the faceplate 14 and the body 20. The coating 22 provides an electrode means for applying an electrical potential to the facing surface of the body 20. The coating may consist of any transparent conductive material which is an n-type semiconductor, such as tin oxide, or a metal having a low work function less than about 5.0eV., such as aluminum.

Tube 10 includes an electron beam forming and scanning means 21 (partially shown in FIG. 1) for scanning an electron beam within an evacuated central cavity of the bulb 12 to impinge upon the available or exposed major surface 23 of the body 20 in raster fashion.

Figure 2:
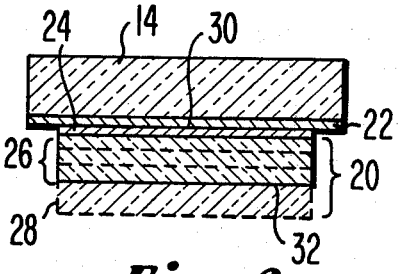
FIG. 2 is a greatly exaggerated cross-sectional view of the end portion of the tube depicted in FIG. 1.

Referring to FIG. 2, an exaggerated view of the faceplate 14, coating 22, and two possible embodiments of the photoconductive body 20 is shown. The photoconductive body 20 comprises in a direction extending from the coating 22; a thin tellurium film or layer 24; a layer of panchromatic polycrystalline hexagonal (trigonal) selenium 26 and an optional layer 28 of tellurium dioxide, $TeO_2$. The selenium layer 26 is doped with thallium in the manner hereinafter disclosed, to a level of from about 100 to about 10,000 parts-per-million-atomic (ppma). Preferably, however, the thallium dopant level is on the order of about 1,000 ppma.

Unlike prior art attempts to employ polycrystalline selenium bodies for imaging devices, the body 20 herein disclosed includes thallium doping of the selenium layer as a consequence of solid-to-solid diffusion accomplished at opposing surfaces of the selenium layer during fabrication. The thallium containing layers applied during processing effectively diffuse within the grain boundaries of the polycrystalline selenium thereby increasing its resistivity and producing a single polycrystalline selenium layer 26 doped with thallium. This increased through-resistivity of the layer 26 together with a blocking contact, which has electrical characteristics similar to a PN rectifying junction formed at the interface with the coating 22, results in a high resistance photoconductive body 20 having particularly low values of dark current and other highly desireable electrical characteristics for use in imaging devices.

In the target 16, a thin insulating layer may be interposed in sandwich fashion between the coating 22 and the layer 26, to advantage. Such insulating layers could, for example, comprise oxidated surface regions of the material composition of the coating 22, so long as the thickness of that coating is sufficiently thin to maintain the desired rectifying characteristics of the blocking contact and thin enough to permit adequate tunneling or injection of electrons through that layer from the selenium layer 26. Thus, while the coating 22 may be in direct abutting contact with the selenium layer 26; it may also be, in a broader sense, "intimately proximate" thereto by the incorporation of another thin layer of material therebetween, such as the insulating layer just described. The coating 22 must be sufficiently proximate (i.e. "intimately proximate") to the layer 26 to form a rectifying junction therewith.

In a preferred method, the body 20 is fabricated along the available surface of a transparent tin oxide conductive coating 22 which has been predeposited along the major surface 18 of a glass faceplate or substrate in a manner well known in the art. The photoconductive body 20 may be fabricated as follows:

Initial Deposition

A workpiece, including the coating 22 along the major surface 18 of glass substrate 14, is initially placed in a chamber which is thereafter evacuated to a pressure level of less than $10^{-4}$ torr. Pressure levels of less than about $10^{-5}$ torr, however, are preferred. A thin layer of tellurium 24 of from about 15A to about 60A thick is thereafter vapor deposited along the available surface 30 of coating 22. The tellurium layer is preferably about 30A in thickness. Thereafter, a thin layer of thallium or thallium containing material such as a thallium-selenium compound ($Tl_2Se_3$ or $Tl_2Se$) from about 20A to about 120A in thickness is vapor deposited along the tellurium layer. Preferably the thallium layer is about 30A in thickness. A layer of amorphous or vitreous selenium is thereafter vapor deposited along the available surface of the thallium layer to a thickness of from about 2 $\mu$m to about 8 $\mu$m. The amorphous selenium layer preferably is about 4 $\mu$m in thickness. The workpiece 50 processed is approximately at ambient room temperature (i.e. unheated).

Crystallization

After the initial deposition cycle, the workpiece is baked at a temperature of from about 150° C. to about 190° C. in an atmosphere of air, oxygen, or oxygen and water vapor, for a period of time from about 15 to about 60 minutes to substantially convert the selenium layer to the polycrystalline hexagonal form of selenium, as evidenced by the formation of a characteristic gray opaque crystalline layer. A crystallization temperature of about 180° C. is preferred.

During crystallization of the selenium layer, the thin tellurium layer 24 is thought to partially diffuse within the surface region of the abutting selenium layer 26, thus forming a thin region of selenium-tellurium alloy at the interface. An extremely thin film substantially of tellurium remains in contact with the electrode 18, serving as a mechanical buffer region for preventing peeling and cracking of the crystalline layer 26 from the coating 22 during and after the crystallization step. The incorporation of the intermediate tellurium buffer region in the disclosed device avoids the necessity of providing surface discontinuities (e.g., by surface roughening techniques) along the surface of coating 22 prior to the deposition of the selenium layer 26 to insure the mechanically stable adhesion of that overlying layer in the resulting structure.

The thickness of the resulting tellurium thin film may be adjusted, for example, by controlled diffusion of the tellurium layer 24 within the selenium layer 26, so long as an effective thickness of the tellurium film is retained for achieving a mechanically stable contact between the coating 22 and selenium layer 26.

Second Deposition

As a third step, which is optional, a thin layer of thallium or thallium containing material such as thallium selenide from about 15A to about 500A thick is vapor deposited along the crystallized selenium layer of the workpiece resulting from the previous step. This thallium layer is preferably about 30A and is vapor deposited along a workpiece which is preferably maintained at the ambient room temperature.

Diffusion

The workpiece resulting from the previous step is subjected to a baking cycle in an atmosphere of air, oxygen, or oxygen and water vapor, for an effective period of time necessary to substantially complete the diffusion of thallium from the abutting thallium layer(s) (the interfacing surfaces of which are shown as dashed lines in FIG. 2), into the crystalline selenium layer.

A time-temperature diffusion sequence is selected for this step which optimizes the quality of the photoconductive body 20 by minimizing such undesireable surface defects as "mottling" (i.e. a nonhomogeneous physical structure which produces an undesired and perceptible variation in the color or appearance in the detected image). In this regard, a sequence or series of incremental diffusion baking steps has been found particularly beneficial wherein the preliminary or initial temperature bake of the workpiece is at temperatures of less than about 60° C. for period of time greater than about 15 minutes. A preliminary temperature bake at about 50° C. is preferred. A series of one or more intermediate baking periods may thereafter be achieved between that preliminary temperature and a desired final diffusion temperature for similar periods of time. Alternatively, the intermediate diffusion baking steps may comprise a gradual continuous increasing of the diffusion baking temperature at a rate, for example, of about 5° C. per minute until a final or ultimate temperature between about 140° C. and 180° C. is achieved. A final baking of the workpiece at that final temperature is thereafter accomplished for a period of time in excess of about 15 minutes. A final baking temperature of about 150° C. is preferred. The gradual increasing of the diffusion baking temperature, from an initial or preliminary value less than about 60° C., to the final temperature has been found to be particularly helpful in reducing the surface "mottling" noted.

Optional Diffusion/Anneal and Post Deposition

While the aforementioned steps may be employed for fabricating useable photoconductive bodies, preferred embodiments of the photoconductive body have been found to result from the following additional steps:

After the completion of the foregoing steps, the photoconductive body should be subjected to diffusion/anneal baking at a temperature of from about 80–120° C. in an atmosphere of air, oxygen, or oxygen and water vapor for a period of time necessary for decreasing the dark current associated with the body by a factor of two or three, and also for improving the cosmetic quality of that body, thereby also improving the quality of the detected image. Preferably this baking step is of a temperature of about 100° C. for a period of time of about 16 hours in an oxygen atmosphere.

A layer 28 of tellurium dioxide, $TeO_2$ is also preferably thereafter vapor deposited along the available major surface of the body. The addition of the tellurium dioxide layer 28 is effective for reducing signal buildup and lag associated with the operation of the body 20 within a vidicon target. The tellurium oxide layer preferably is about 25A thick; however, a thickness of from about 10A to about 125A may be employed to advantage.

Photoconductive bodies fabricated in the previously described manner have been found to produce highly sensitive vidicon targets having dark currents as low as $10nA/cm^2$ at voltages approaching 30 volts. In general, photoconductive bodies of this type may be fabricated along n-type semiconductors such as, for example, tin oxide transparent coatings, or low work function metal materials such as aluminum to provide a "blocking contact" at the planar interface region between coating 22 and the body 20.

The "blocking contact" as herein defined comprises a rectifying junction whereby non-photogenerated holes are substantially "blocked" or prevented from entering or being conducted into the P-type selenium layer from a suitable positive source of electric potential (connected to the ring 17 and coating 22 during operation of the tube 10) and whereby photogenerated minority carriers (electrons) within the P-type selenium layer may be effectively conducted through that junction to combine with such holes as are accumulated along the coating 22. The blocking contact fabricated is described more fully in our U.S. Pat. No. 3,990,095, issued Nov. 2, 1976, entitled "Selenium Rectifier Having Hexagonal Polycrystalline Selenium Layer" filed simultaneously herewith and herein incorporated by reference.

In the operation of the tube 10, (FIG. 1) suitable voltages are applied to various ones of its internal electrodes in a manner well known in the art. During operation, a light image from the viewed scene passes through the faceplate 14 and the coating 22 and generates electron-hole carrier pairs in the selenium layer 26 in accordance with the intensity pattern of light from the viewed scene. Photogenerated electrons so generated within the layer 26 sweep across the body 20 and eventually recombine with holes accumulated along the portion of coating 22 which abuts the blocking contact.

In one mode of operation of the tube 10, a low velocity electron beam is scanned in raster fashion along the surface 23 of the target 16 to establish a negative electric charge along that surface. That negative electric charge, being essentially an accumulation of electrons, thereafter is discharged during the period between successive scans of the electron beam when photogenerated holes, generated in aforementioned manner, recombine with such electrons, substantially forming a charge image replica of the viewed scene. A signal output is thereafter obtained from the ring 17 as a result of the recharging by the returning electron beam of successively scanned surface regions of surface 23 so discharged. Thus, the rescanning of the electron beam in this fashion during the operation of tube 10 provides a means whereby an electrical output signal is substantially generated in accordance with the viewed scene.

The method of fabrication of the body described is relatively simple and repeatable and results in a target having a particularly desired cosmetic structure substantially devoid of surface mottling.

Typical vidicon targets, fabricated by the method described, have been evaluated and found to possess the following approximate characteristics (scan area of $\frac{3}{8}'' \times \frac{1}{2}''$) compared to a standard $Sb_2S_3$ type vidicon target of similar construction:

| | Standard $Sb_2S_3$ Vidicon | Polycrystalline Se Vidicon |
|---|---|---|
| Operating Volt. Range (Volts) | 20–40 | 15–30 |
| Nominal Dark Current (nA.) | 20 | 5–10 |
| Sensitivity at 550nM. (A/W) | 0.105 | 0.270 |
| Peak Quantum Efficiency | — | 60 |
| Lag at 50 m-Sec. & 200nA. (%) | 25 | 10 |

Figure 3:
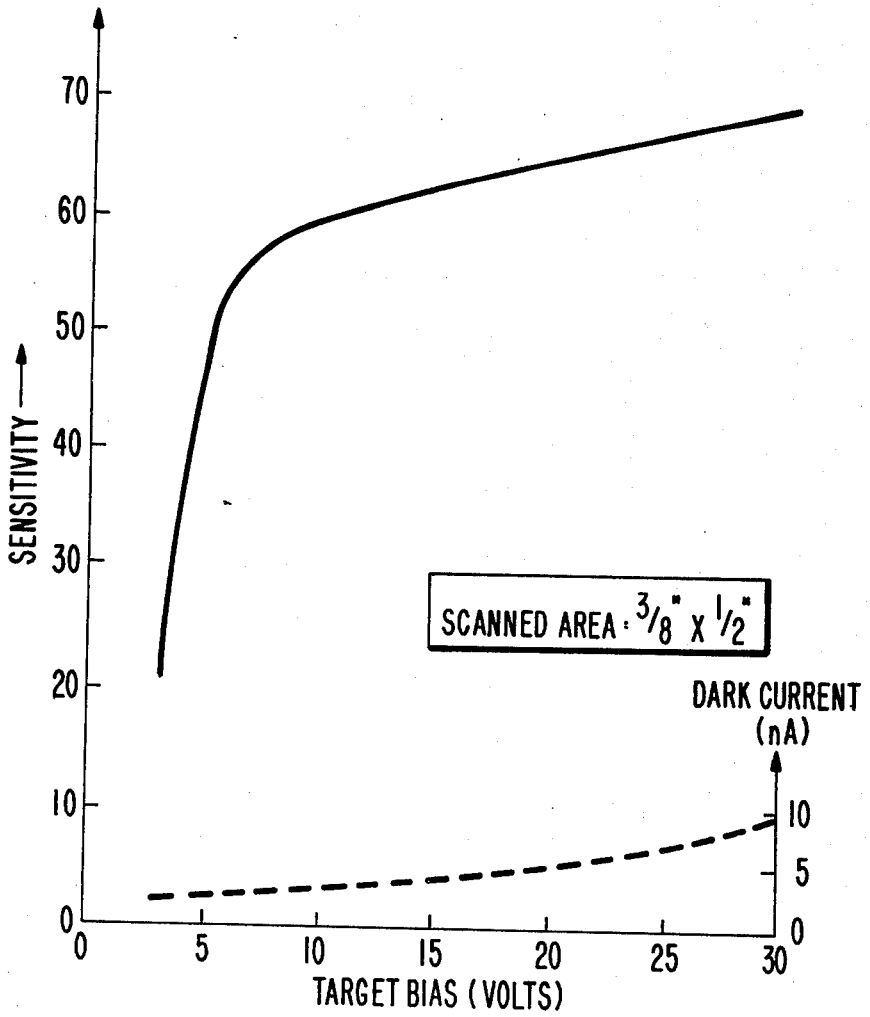
FIG. 3 is a graphical presentation of sensitivity and dark current values of a typical tube of the type depicted in FIGS. 1 and 2 in relation to various target bias or operating voltages.

Typical sensitivity and dark current values obtained for such tubes are shown in FIG. 3 relative to various target bias or operating voltages. While the invention has been described in the preferred embodiment as a target for a vidicon-type camera tube, persons of ordinary skill in the art could employ a substantially similar structural arrangement for use as an electrophotographic plate without deviating from the inventive concept. The inventive concept applies broadly to photoconductive imaging devices wherein radiation image patterns are detected by a high resistance low dark current photoconductive polycrystalline selenium body of the type herein disclosed.

What we claim is:

1. A photoconductive imaging device comprising:
(a) a thallium doped layer of hexagonal polycrystalline selenium;
(b) a layer of tin-oxide in intimate proximity to said selenium layer and forming therewith a mechanically stable blocking contact for holes abutting said selenium layer;
(c) a thin film of tellurium disposed between said tin-oxide layer and said selenium layer; and
(d) means whereby a charge pattern may be established along said selenium layer substantially as a charge replica of an image impinging upon said selenium layer.

2. The device of claim 1 wherein said selenium layer is doped with thallium to a level between about 100 and 10,000 ppma.

3. The device of claim 2 wherein said selenium layer is doped with thallium to level of about 1000 ppma.

4. A photoconductive imaging device comprising:
(a) an electrode of a material selected from the group consisting of n type semiconductors and the metals having a low work function below about 5 eV;

(b) a photoconductive body, including a thallium doped layer of hexagonal polycrystalline selenium, overlying said electrode, said selenium layer being in intimate proximity to said electrode and forming therewith a mechanically stable blocking contact;

(c) a thin film of tellurium disposed between said electrode and said layer;

(d) means for a major surface of said selenium layer, opposite the major surface thereof proximate said electrode, whereby a negative charge may be provided along said selenium layer in electrical cooperation with said electrode and whereby a residual charge intensity pattern may be formed substantially there along as a charge replica of an image impinging upon said selenium layer.

5. A photoconductive device in accordance with claim 4 wherein said device is a vidicon-type camera tube and further comprises:

said electrode consisting of a layer of tin oxide along an inner surface of a faceplate, and said means comprises an electron beam forming and scanning means capable of scanning an electron beam in raster fashion across a major surface of said photoconductive body opposite said electrode.

6. The photoconductive device of claim 5 wherein said body further comprises a layer of tellurium dioxide along a surface of said selenium layer, facing said electron beam forming and scanning means, along which said electron beam may be scanned.

7. The photoconductive device of claim 6 wherein said selenium layer is doped with thallium to a level between about 100 and about 10,000 ppma.

8. The photoconductive device of claim 7 wherein said selenium layer is doped with thallium to a level of about 1000 ppma.

* * * * *